US011090230B2

(12) United States Patent
Arends

(10) Patent No.: US 11,090,230 B2
(45) Date of Patent: Aug. 17, 2021

(54) FORMULA CONTAINER

(71) Applicant: Beau Bebe Pty Ltd, Queensland (AU)

(72) Inventor: Alison Rebecca Arends, Queensland (AU)

(73) Assignee: Beau Bebe Pty Ltd, Queensland (AU)

( * ) Notice: Subject to any disclaimer, the term of this patent is extended or adjusted under 35 U.S.C. 154(b) by 601 days.

(21) Appl. No.: 15/240,738

(22) Filed: Aug. 18, 2016

(65) Prior Publication Data

US 2017/0049663 A1 Feb. 23, 2017

(30) Foreign Application Priority Data

Aug. 19, 2015 (AU) ..... 2015903362

(51) Int. Cl.
*A61J 9/00* (2006.01)
*A47G 19/22* (2006.01)
(Continued)

(52) U.S. Cl.
CPC ..... *A61J 9/001* (2013.01); *A47G 19/2205* (2013.01); *A47G 19/2272* (2013.01); *A61J 1/20* (2013.01);
(Continued)

(58) Field of Classification Search
CPC .... A61J 9/00; A61J 1/2093; A61J 1/20; A61J 9/001; A61J 9/005; A61J 11/00; A61J 11/008; A61J 11/04; A47G 19/2205; A47G 19/2272; B65D 47/127; B65D 47/2018; B65D 81/3211
See application file for complete search history.

(56) References Cited

U.S. PATENT DOCUMENTS 3,163,163 A 12/1964 Wilburn
7,789,854 B2 9/2010 Talamonti
(Continued)

FOREIGN PATENT DOCUMENTS

GB 2501755 11/2013
WO WO2004014739 2/2004

OTHER PUBLICATIONS

Exam Report for corresponding Australia Patent Application No. 2016216629 dated Jan. 21, 2021, 10 pages.

*Primary Examiner* — Shawn M Braden
(74) *Attorney, Agent, or Firm* — Lee & Hayes, P.C.

(57) ABSTRACT

A beverage formula container for use with a beverage receptacle, the beverage formula container including a container body extending from a first open end configured for dispensing a beverage to a second open end configured for attachment to a beverage receptacle body of the beverage receptacle, the container body including a flared section and an at least partially deformable section in proximity of the flared section and a sealing member configured to be inserted into the second end so as to sealingly engage an inner surface of the container body proximate the flared section so as to form a chamber between the sealing member and the first end, the chamber being configured to receive beverage formula therein, and wherein deformation of the deformable section allows the sealing member to disengage the inner surface of the container body and pass through the flared section and the second end, thereby releasing beverage formula through the second end into an attached beverage receptacle body.

18 Claims, 14 Drawing Sheets

(51) Int. Cl.

| | |
|---|---|
| ***A61J 1/20*** | (2006.01) |
| ***A61J 11/00*** | (2006.01) |
| ***A61J 11/04*** | (2006.01) |
| ***B65D 47/12*** | (2006.01) |
| ***B65D 47/20*** | (2006.01) |
| ***B65D 81/32*** | (2006.01) |

(52) U.S. Cl.

CPC ..... *A61J 1/2093* (2013.01); *A61J 9/00* (2013.01); *A61J 9/005* (2013.01); *A61J 11/00* (2013.01); *A61J 11/008* (2013.01); *A61J 11/04* (2013.01); *B65D 47/127* (2013.01); *B65D 47/2018* (2013.01); *B65D 81/3211* (2013.01)

(56) References Cited

U.S. PATENT DOCUMENTS

| | | | | |
|---|---|---|---|---|
| 8,556,094 | B2 | 10/2013 | Brown et al. | |
| 9,580,227 | B2 * | 2/2017 | Wood | B65D 81/3266 |
| 2005/0056610 | A1 * | 3/2005 | Randolph | A61J 9/001 215/11.1 |
| 2007/0084819 | A1 | 4/2007 | Fialkowski | |
| 2013/0228481 | A1 | 9/2013 | Nobbio | |
| 2014/0102918 | A1 * | 4/2014 | Eitrheim | A61J 9/00 206/219 |
| 2014/0102919 | A1 * | 4/2014 | Gutierrez | A61J 9/04 206/221 |
| 2014/0305817 | A1 | 10/2014 | Guery et al. | |
| 2016/0096673 | A1 * | 4/2016 | Leibovitch | A61J 1/20 426/2 |
| 2016/0368694 | A1 * | 12/2016 | Rahmel | B65D 47/2018 |
| 2018/0140510 | A1 * | 5/2018 | Maldonado | A61J 11/006 |
| 2018/0207064 | A1 * | 7/2018 | Geels | A61J 9/00 |

* cited by examiner

FORMULA CONTAINER

BACKGROUND OF THE INVENTION

The present invention relates to a formula container and in particular to a formula container for use in forming a liquid formulation, such as a beverage, and which in one example can form part of a nursing bottle, sippy cup or other beverage receptacle.

DESCRIPTION OF THE PRIOR ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

It is known to provide beverage formulas, such as powder or liquid concentrates, which can be subsequently mixed with water to provide functional beverages, such as an infant formula beverage. This is typically performed by mixing the formula and water to create the beverage, which is then provided in a suitable receptacle such as a nursing bottle. This process involves using clean hands to pour a specific amount of pre-boiled water into a clean nursing bottle, normally by reference to measurement markings on the bottle, opening the dry formula container and, using a measuring spoon, adding a specific amount of dry formula to the water in the nursing bottle, securing the teat and bottle lid to the bottle and agitating the bottle to ensure the dry formula dissolves. It is recommended that for the baby's health, it is important that the mixed formula is in the correct proportions of water to formula. The water or the mixed formula may be warmed before the baby consumes it. Dry formula can harbour bacteria, and it can be inadvertently exposed to bacteria during the process of preparing a bottle. While the formula remains dry it is considered safe because bacteria cannot grow or multiply.

Once dry formula is mixed with water, it is recommended that it be consumed within one hour or discarded due to the risk of the formula growing harmful bacteria. There are often times when it is not convenient or even possible for a care-giver to correctly prepare infant formula immediately before the baby requires it. Examples include night-time feeds, feeding at a public place, when the care-giver is holding or otherwise caring for the baby or where the care-giver is a babysitter who lacks the confidence or competence to correctly prepare the bottle.

A number of solutions have been proposed to allow some of the preparation of an infant formula bottle to be performed in advance when it can be done conveniently and properly, thereby reducing the preparation required when it is not convenient or possible. One solution is to temporarily store the dry formula and the water in separate chambers within a nursing bottle, with a means of later mixing the formula and water without opening the bottle.

U.S. Pat. No. 8,556,094 describes a baby formula delivery assembly and includes a container that has a bottom wall, a top wall, and a perimeter wall extending between the top and bottom walls. A housing has an upper wall and a peripheral wall that is attached to and extends downwardly from the upper wall. The peripheral wall extends downwardly around the container adjacent to the top wall and is rotatably and non-removably coupled to the container. A lower wall is attached to the peripheral and is spaced from the upper wall and defines an interior space of the housing. The lower wall has a second powder aperture extending therethrough. A nipple is attached to the upper wall and is in fluid communication with the interior space of the housing. A quantity of water is positioned within the container. A quantity of baby formula is positioned within the housing.

However, this arrangement requires moving parts in the forms of the relatively movable lower and top walls. This is complex from a manufacturing and use perspective, whilst also providing a region into which fluid can pass, either in the form of diluted formula during drinking, or water during washing or sterilisation. This in turn makes the arrangement difficult to clean, which is important in ensuring the necessary degree of sterility required for use. It further makes it difficult to dry which is important to prevent unwanted exposure of the formula to moisture, which can result in the growth of harmful bacteria. If a care-giver cannot feel confident that the arrangement is clean and dry before use, this defeats the purpose of the arrangement. Further, the presence of moisture in the housing containing dry formula can cause the formula to form clumps, inhibiting the effective mixing and dilution of the formula.

US2014/0102919 describes a container for storing and dispensing a substance comprising a deformable nipple having an open end, a feeding tip and a storage cavity; a lid adapted to releasably engage said open end of said nipple; and (optionally) a tether having resilient properties, said tether connecting said nipple to said lid; wherein, in a storage position said substance, when placed within said storage cavity of said nipple, is contained; wherein in a mixing position, said substance is released from said storage cavity of said nipple; and wherein said container transitions from said storage position to said mixing position upon application of an external force to said nipple, causing said nipple to deform and said lid to disengage said open end of said nipple.

However, in this arrangement, the infant formula must initially be provided into the teat before the lid is closed. Infant formula particles are light and there is a risk of some particles landing on the underside of the rim of the teat rather than inside the teat. Part of the underside of the rim of the teat is exposed to the bottle when the teat is correctly attached the bottle, which contains water and therefore there is a risk of unwanted exposure of some formula to water. Further, the arrangement includes a number of discontinuities and sharp corners which in use will come into contact with the infant formula. This makes these corners difficult to clean and dry thoroughly. Both these aspects are problematic in terms of ensuring that no moisture comes into contact with the dry formula until that is desired, for the reasons outlined above.

US2014/0102918 describes a reusable, portable attachment for coupling in between a baby bottle top and a baby bottle container that comprises a container compartment for storing powdered formula separately from water prior to feeding, a hollow compartment, a removable seal therebetween, and a release actuator for releasing the seal to mix the powdered formula and water.

In this arrangement, an actuator system is required in order to release the plug. Such actuators are complex and hence are costly to manufacture, provide an additional point of failure, are easily inadvertently actuated. Additionally the arrangement again includes discontinuities and sharp edges leading to problems with adequate cleaning and drying, as outlined above.

It will be appreciated that similar issues arise with respect to the preparation of other liquid formulations, including but not limited to liquid beverages, as well as medicinal and nutraceutical formulations.

SUMMARY OF THE PRESENT INVENTION

In one broad form the present invention seeks to provide a beverage formula container for use with a beverage receptacle, the beverage formula container including:

a) a container body extending from a first open end configured for dispensing a beverage to a second open end configured for attachment to a beverage receptacle body of the beverage receptacle, the container body including:
   i) a flared section; and,
   ii) an at least partially deformable section in proximity of the flared section; and, b) a sealing member configured to be inserted into the second end so as to sealingly engage an inner surface of the container body proximate the flared section so as to form a chamber between the sealing member and the first end, the chamber being configured to receive beverage formula therein, and wherein deformation of the deformable section allows the sealing member to disengage the inner surface of the container body and pass through the flared section and the second end, thereby releasing beverage formula through the second end into an attached beverage receptacle body.

In one broad form the present invention seeks to provide a beverage receptacle including:

a) a beverage receptacle body;
b) a lid;
c) a beverage formula container including:
   i) a container body extending from a first open end configured for attachment to the lid to a second open end configured for attachment to the beverage receptacle body, the container body including:
      (1) a flared section;
      (2) an at least partially deformable section in proximity of the flared section; and, d) a sealing member configured to be inserted into the second end so as to sealingly engage an inner surface of the container body proximate the flared section so as to form a chamber between the sealing member and the first end, the chamber being configured to receive beverage formula therein, and wherein deformation of the deformable section allows the sealing member to disengage the inner surface of the container body and pass through the flared section and the second end, thereby releasing beverage formula through the second end into an attached beverage receptacle body.

In one broad form the present invention seeks to provide a nursing bottle including:

a) a nursing bottle body;
b) a teat;
c) a teat ring;
d) a beverage formula container including:
   i) a container body extending from a first open end configured for attachment to the teat to a second open end configured for attachment to the nursing bottle body, the container body including:
      (1) a flared section proximate the second end;
      (2) at least one ridge extending around at least part of a perimeter of an inner surface of the container body proximate the flared section; and,
      (3) an at least partially deformable section in proximity of the ridge; and,
   ii) a sealing member configured to be inserted into the second end so as to sealingly engage an inner surface of the container body proximate the flared section so as to form a chamber between the sealing member and the first open end, and wherein deformation of the deformable section allows the sealing member to disengage the inner surface of the container body and pass through the flared section and the second end, thereby releasing beverage concentrate through the second end into the nursing bottle body.

In one broad form the present invention seeks to provide a method of preparing a beverage in a beverage receptacle, the method including:

a) positioning a sealing member in a container body, the container body extending from a first open end configured for dispensing a beverage to a second open end configured for attachment to the beverage receptacle body, the container body including:
   i) a flared section;
   ii) an at least partially deformable section in proximity of the flared section, the method including positioning the sealing member by inserting the sealing member into the second end so as to sealingly engage the inner surface of the container body proximate the flared section so as to form a chamber;
b) providing the beverage formula into the chamber;
c) attaching the second end to a beverage receptacle body containing water; and,
d) deforming the deformable section to allow the sealing member to disengage the inner surface of the container body and pass through the flared section and the second end, thereby releasing beverage concentrate through the second end into the attached beverage receptacle body.

In one broad form the present invention seeks to provide a formula container for use in preparing a liquid formulation, the formula container including:

a) a container body extending from a first end configured for dispensing a liquid formulation to a second open end configured for attachment to a receptacle body, the container body including:
   i) a flared section; and,
   ii) an at least partially deformable section in proximity of the flared section; and,
b) a sealing member configured to be inserted into the second end so as to sealingly engage an inner surface of the container body proximate the flared section so as to form a chamber between the sealing member and first end, the chamber being configured to receive formula therein, and wherein deformation of the deformable section allows the sealing member to disengage the inner surface of the container body and pass through the flared section and the second end, thereby releasing formula through the second end into an attached receptacle body, whereby the formula is mixed with a liquid contained in the receptacle body to form the liquid formulation.

In one broad form the present invention seeks to provide a method for use in preparing a liquid formulation, the method including:

a) positioning a sealing member in a container body, the container body extending from a first open end configured for dispensing a liquid formulation to a second open end configured for attachment to a receptacle body, the container body including:

i) a flared section;

ii) an at least partially deformable section in proximity of the flared section, the method including positioning the sealing member by inserting the sealing member into the second end so as to sealingly engage the inner surface of the container body proximate the flared section so as to form a chamber;

b) providing formula into the chamber;

c) attaching the second end to a receptacle body containing a liquid; and, d) deforming the deformable section to allow the sealing member to disengage the inner surface of the container body and pass through the flared section and the second end, thereby releasing formula into the attached receptacle body whereby the formula is mixed with a liquid contained in the receptacle body to form the liquid formulation.

Typically the formula container includes at least one ridge extending around at least part of a perimeter of an inner surface of the container body proximate the flared section and wherein the sealing member is configured to abut against the at least one ridge when the sealing member is inserted into the second end in use.

Typically the at least one ridge is integrally formed with the container body.

Typically the at least one ridge includes a sloped face that abuts against a sloped face of the sealing member and wherein abutment of the sloped faces prevents ingress of beverage formula into a seal between the sealing member and the container body.

Typically the sealing member includes at least one sealing member ridge extending around at least part of a perimeter of the sealing member and wherein the at least one sealing member ridge is configured to abut against at least part of the flared section when the sealing member is inserted into the second end in use.

Typically the sealing member includes at least two sealing member ridges spaced apart and extending around a perimeter of the sealing member, wherein the sealing member ridges abut against the inner surface to form a double seal.

Typically the inner surface defines a continuous surface into which beverage or beverage formula can come into contact in use.

Typically the continuous surface does not include any discontinuities.

Typically the continuous surface does not include any angles greater than at least one of 90°; 80°; 70°; 60°; 50°; 45°; 40°; and 30°.

Typically deformation of the at least partially deformable section causes at least one of:

a) urging of the sealing member into the flared section;

b) expansion of a container body diameter proximate the flared section;

c) engagement of at least one ridge with a surface of the sealing member;

d) deformation of the sealing member;

e) contraction of the sealing member; and, f) fracturing of the sealing member.

Typically deformation of the at least partially deformable section causes at least part of at least one ridge to move radially inwardly and engage a sloped face of the sealing member, thereby urging the sealing member towards the flared section so that the sealing member disengages the inner surface.

Typically deformation of the at least partially deformable section causes at least part of at least one ridge to move radially inwardly and towards the flared section to engage a face of the sealing member, thereby urging the sealing member towards the flared section so that the sealing member disengages the inner surface.

Typically the sealing member includes a sealing member body that is at least one of:

a) ellipsoidal; and, b) cylindrical.

Typically the sealing member engages the inner surface of the container body to thereby form a seal.

Typically the sealing member is made of at least one of:

a) plastic;

b) silicone;

c) rubber;

d) latex;

e) an elastomer;

f) a metal;

g) a shape memory alloy; and, h) aluminium.

Typically the container body is made of at least one of:

a) plastic;

b) silicone;

c) rubber;

d) latex;

e) an elastomer; and, f) aluminium.

Typically the container body is substantially cylindrical and hollow.

Typically the flared section increases a diameter of the inner surface of the container body, allowing the second end to fit over a mouth of the beverage receptacle body.

Typically the flared section includes at least one of:

a) a groove in a wall of the container body;

b) a depression in a wall of the container body; and, c) a thinning in a wall thickness of the container body.

Typically the body includes ribbing configured to control deformation of the deformable section.

Typically the first end is configured for attachment to at least one of:

a) a lid;

b) a removable lid;

c) a pierceable lid;

d) a sippy cup lid including a spout;

e) a travel mug lid; and, f) a teat.

Typically the receptacle includes at least one of:

a) a beverage receptacle;

b) a travel mug;

c) a nursing bottle body; and, d) a sippy cup body.

Typically an outer surface of the first end includes threads configured to threadingly engage a teat ring allowing a teat to be coupled thereto and wherein an inner surface of the second end includes bottle threads configured to threadingly engage a nursing bottle body allowing the container body to be coupled thereto.

Typically the first and second end engage respective threaded locking rings configured to threadingly engage a teat ring and a nursing bottle body respectively.

Typically the beverage formula includes at least one of:

a) powdered infant formula;

b) liquid infant formula;

c) a nutritional composition;

d) a medicated formulation; and, e) an isotonic drink formulation.

Typically the nursing bottle is configured for use with a re-usable lining member containing the beverage and wherein the nursing bottle includes a hole allowing air flow into a region between the nursing bottle body and the lining member.

Typically the lining member includes a neck configured for attachment to a mouth of the nursing bottle body.

Typically the lining member is a reusable lining member.

Typically the lining member is made of at least one of plastic and silicone.

Typically the method includes attaching the first end to a receptacle lid after providing the beverage formula therein.

Typically the method includes mixing the beverage formula and water by at least one of agitating and shaking the beverage receptacle.

It will be appreciated that the broad forms of the invention and their respective features can be used in conjunction and/or independently, and reference to separate broad forms of the invention is not intended to be limiting.

BRIEF DESCRIPTION OF THE DRAWINGS

An example of the present invention will now be described with reference to the accompanying drawings, in which:—

DETAILED DESCRIPTION OF THE PREFERRED EMBODIMENTS

Figure 1A:
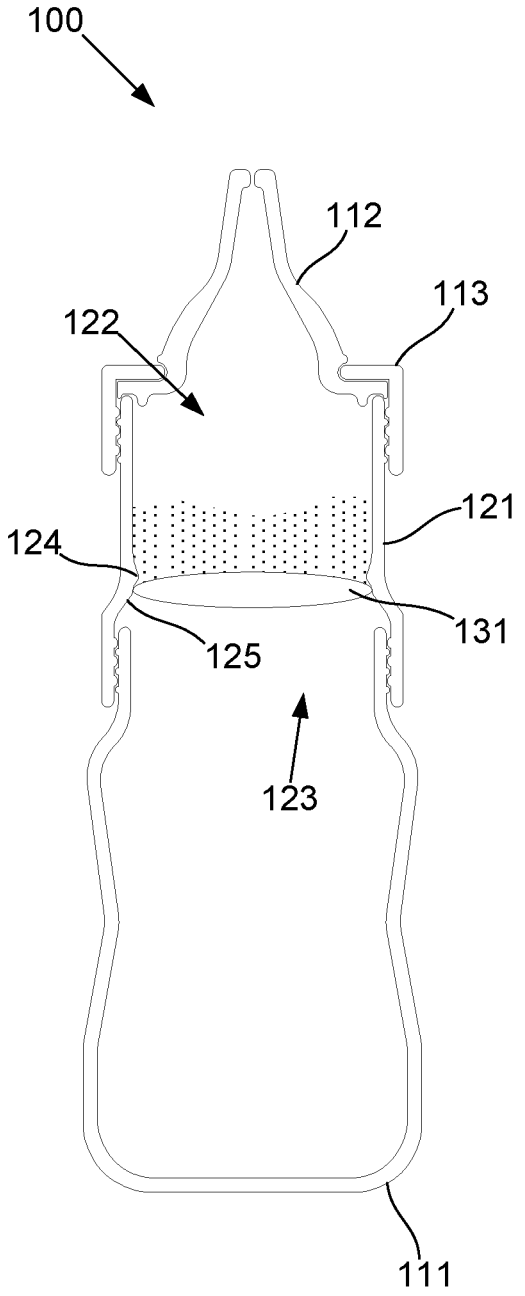
FIG. 1A is a schematic cross-sectional view of an example of a nursing bottle including a beverage formula container with a sealing member in place.
Figure 1B:
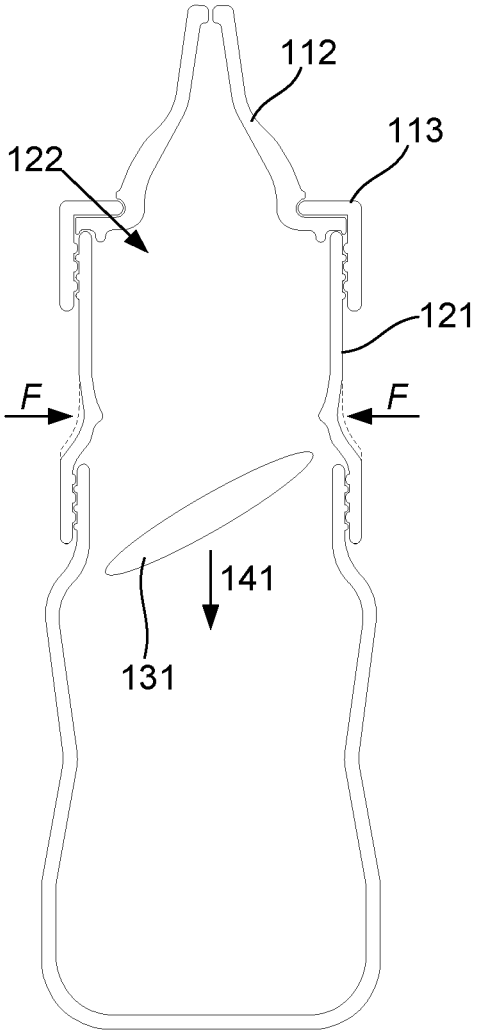
FIG. 1B is a schematic cross-sectional view of the nursing bottle of FIG. 1A with the sealing member released.
Figure 1C:
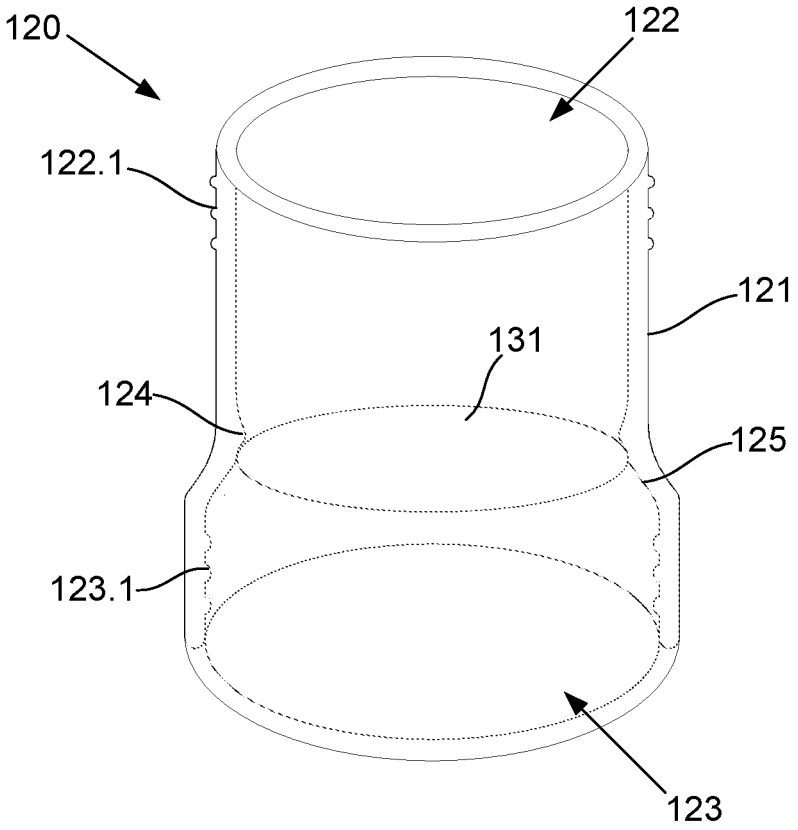
FIG. 1C is a schematic perspective view of the beverage formula container of FIG. 1A.
Figure 1D:
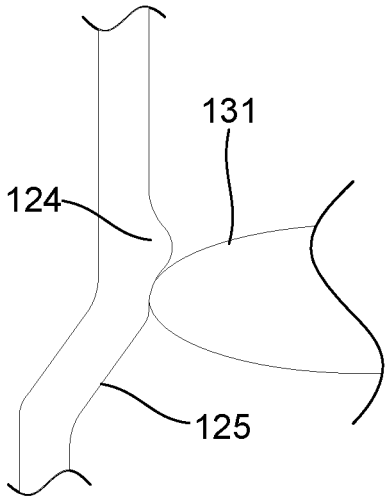
FIG. 1D is a schematic cross-sectional close up view of the ridge and sealing member of FIG. 1A.
Figure 1E:
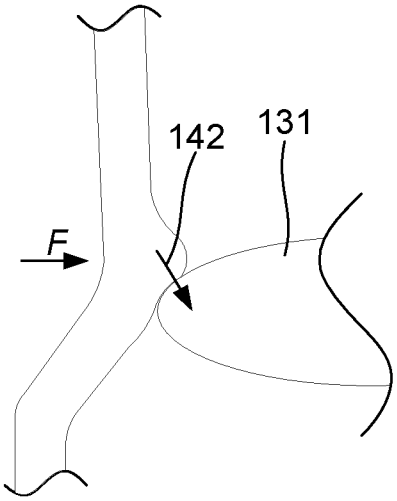
FIG. 1E is a schematic cross-sectional close up view of the ridge and sealing member of FIG. 1A showing the forces caused during deformation of the beverage formula container.
Figure 2A:
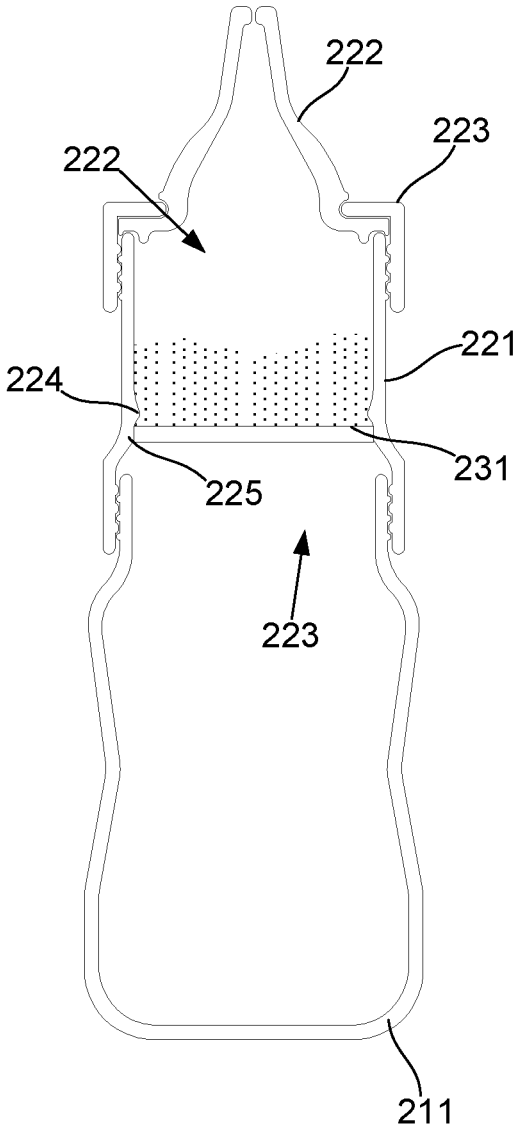
FIG. 2A is a schematic cross-sectional view of a second example of a nursing bottle including a beverage formula container with a sealing member in place.
Figure 2B:
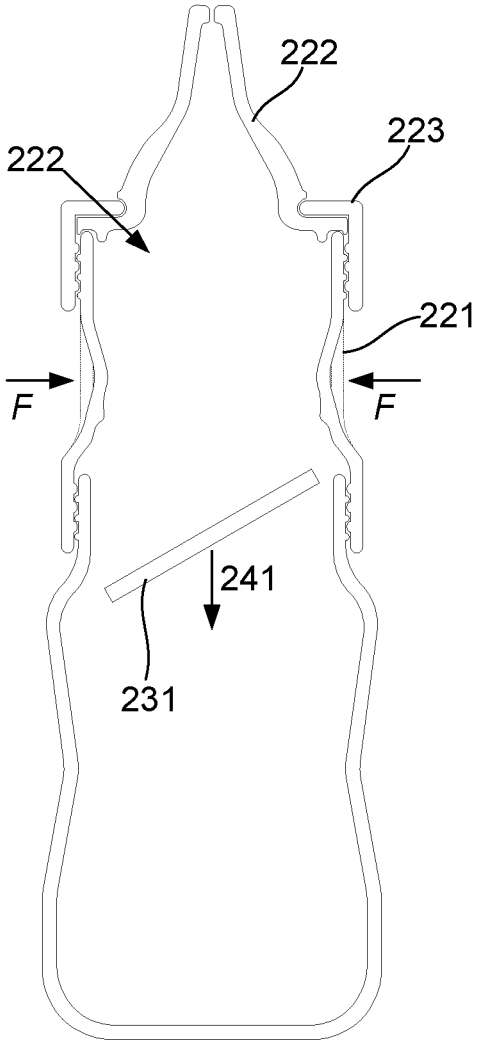
FIG. 2B is a schematic cross-sectional view of the nursing bottle of FIG. 2A with the sealing member released.
Figure 2C:
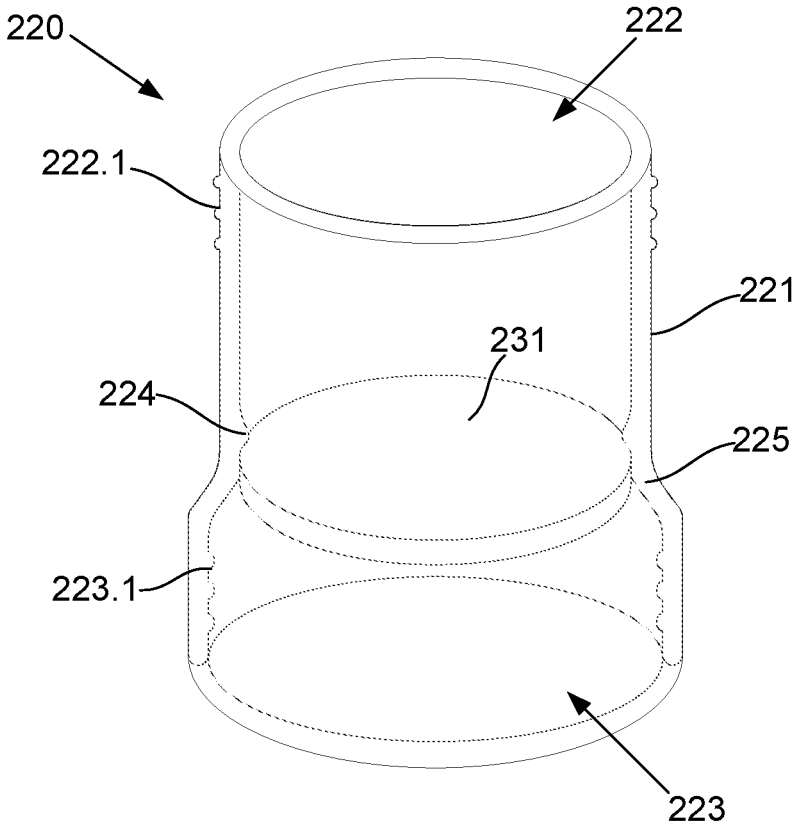
FIG. 2C is a schematic perspective view of the formula container of FIG. 2A.
Figure 2D:
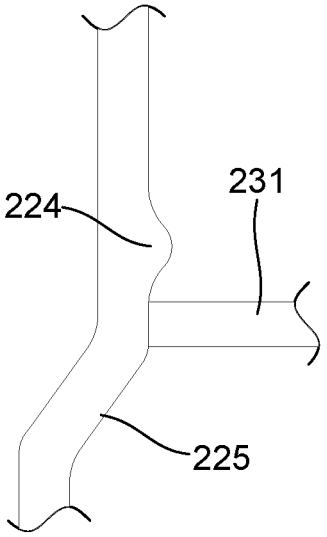
FIG. 2D is a schematic cross-sectional close up view of the ridge and sealing member of FIG. 2A.
Figure 2E:
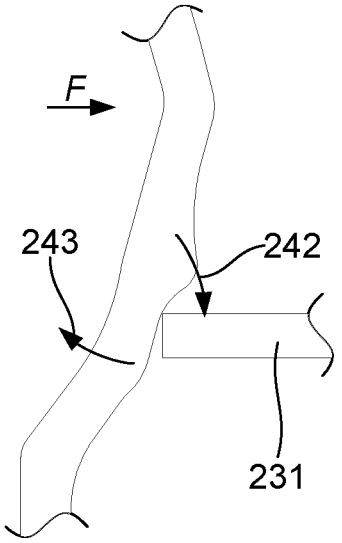
FIG. 2E is a schematic cross-sectional close up view of the ridge and sealing member of FIG. 2A showing the forces during deformation of the formula container.

An example of a beverage formula container will now be described with reference to FIGS. 1A to 1E.

For the purpose of illustration, this example will focus on the use of the beverage formula container with a nursing bottle. However, this is not intended to be limiting and as will be described in more detail below, the formula container could be used with other beverage receptacles, such as sippy cups, travel mugs, or the like, as well as receptacles for dispensing liquid formulations.

In this example, the nursing bottle 100 includes a bottle body 111 and a teat 112 (also known as a nipple), as well as a formula container 120. The formula container 120 includes a container body 121, extending from a first open end 122 configured for attachment to the teat 112, for example via a teat ring 113 or integrated fitting, and a second open end 123 configured for attachment to the nursing bottle body 111. In use a sealing member 131 is provided within the container body to form an open chamber, as will be described in more detail below.

The container body 121 includes a flared section 125, which is typically provided proximate the second end 123 of the container body 121, although this is not essential and other positioning can be used. The flared section provides an increase in diameter or width of the container body 121, and in particular an inner diameter of the container body and is provided to facilitate release of a sealing member 131, whilst optionally also facilitating attachment of the second end 123 of the container body over a mouth of the bottle body 111, as will be explained in more detail below.

The container body 121 also includes an at least partially deformable section proximate the flared section 125. The deformable section may be a discrete portion of the container body, or could be formed by making the entire body at least partially deformable. The deformable section can be defined at least in part by properties of the container body 121, such as the type of material from which the container body 121 is manufactured, the material thickness, material stiffness, as well as the presence or absence of strengthening or stiffening members, such as ribbing or the like, which could be used to control deformation of the deformable section. For example, ribs could be used to control which parts of the container body can deform, and the direction in which deformation occurs.

The sealing member 131 is configured to be inserted into the second end 123 of the container body 121 so as sealingly engage an inner surface of the container body 121 proximate the flared section 125. When in place, as shown in FIG. 1A, the formula container effectively forms an open chamber, allowing a beverage formula to be provided therein through the first open end 122.

Accordingly, in use the sealing member 131 is initially provided into the container body 121 through the second end 123. This can be performed in any suitable manner, typically ensuring cleanliness/sterility requirements are met. For example, this could include positioning the sealing member by hand, or using a machine or tool, particularly in the case of mass manufactured single use disposal formula containers. Infant or another beverage formula, is provided through the first open end 122 and into the open chamber, with the beverage formula resting on the sealing member 131.

Following this, the teat 112 can be coupled to the formula container 120, in this example using the teat ring 113, with the formula container 120 being coupled to the bottle body 111 containing water, either before or after the formula container 120 is loaded with beverage formula. A bottle cap may optionally be placed over the teat to form an airtight seal over the nipple hole, thereby completely encasing the dry formula within an airtight space.

In use, deformation of the deformable section allows the sealing member 131 to disengage the inner surface of the container body 121 and pass through the flared section 125 and second end 123 into the bottle body 111, thereby releasing beverage formula through the second end and allowing this to mix with water contained in the nursing bottle body 111.

Thus it will be appreciated that in the above described arrangement, water (or another appropriate fluid) can be provided into the nursing bottle body 111 with beverage formula being stored in the formula container 120, either prior to or after connection to the bottle body. The teat 112 can then be held in place using the teat ring 113 coupled to the first end 122 of the container body 121. In this arrangement the water and beverage formula are isolated allowing the formula to be stored prior to use. Particularly in the case of powdered formula, this allows the powder to be stored for a significant amount of time which is not the case once the powder and water have been mixed.

When feeding is to be performed, the container body 121 can simply be squeezed, causing the sealing member 131 to fall into the bottle body 111, thereby releasing powder into the water. In this instance it will be appreciated that powder is added to the water, rather than vice-versa, which helps with more effective dissolving of the powder within the water.

Additionally, the process can be further facilitated by shaking or otherwise agitating the contents of the bottle 100 to break up any clumps of powder and ensure that the powder dissolves. This can be aided by movement of the sealing member 131 within the bottle body 111, which agitates the liquid therein, although it will be appreciated that this is not essential.

Accordingly, the above described arrangement provides a mechanism in which powdered infant formula can be readily stored within a container and then released on demand into pre-poured water allowing the liquid beverage to be prepared. The 'release' stage can be performed single-handedly (thereby making it easier for a user to prepare infant formula whilst holding an infant or the like), in poor light (e.g. for a night-time feed), immediately and without the need for the care-giver to wash their hands first or measure any formula or water, and away from kitchen facilities.

Whilst the above explanation has focused on the preparation of powdered infant formula, it will be appreciated that this is only one potential example usage and is not intended to be limiting. For example, this arrangement can also be used with liquid infant formula, nutritional compositions, medicated formulations, isotonic drink formulations or the like. It will be similarly appreciated from this that the nursing bottle is one particular application, and is not intended to be limiting.

By way of alternative, the formula container could be used with any one or more of a beverage receptacle, travel mug, sippy cup or the like. It will be appreciated from this that the second end of the container body can be connected to a suitable receptacle body, whilst the first end could be coupled to any one or more of a lid, a removable lid, a pierceable lid, a sippy cup lid including a spout, a travel mug lid and a teat. Alternatively, this could be aleft open, providing a mouth to allow beverage to be consumed directly from the beverage receptacle through formula container.

A number of further features will now be described.

It will be appreciated from the above that the bottle body 111 and teat 112 can be adapted to be used in conjunction to form a standalone nursing bottle, without the formula container 120, and that this could be in the form of a standard existing nursing bottle, with the formula container 120 being retrofitted thereto. Thus it will be appreciated that the formula container could be manufactured and supplied separately to nursing bottles, and could be specifically adapted for use with specific bottles, for example to including complementary fastenings to attach to the bottle body 111 and teat ring 113. For example, an outer surface of the first end 122 can include teat threads 122.1 configured to threadingly engage the teat ring 113 allowing the teat 112 to be coupled thereto and an inner surface of the second end 123 can include bottle threads 123.1 configured to threadingly engage a nursing bottle body 111, allowing the container body to be coupled thereto. However, this is not essential and any suitable coupling mechanism, and/or configuration of formula container 120, bottle body 111, teat 112 and teat ring 113, could be used.

Similar arrangements could also be used for sippy cups, travel mugs or the like. Additionally, it will be appreciated that the formula container could be integrated into a nursing bottle or other beverage receptacle, for example to provide a single use disposable nursing bottle. In this instance, the nursing bottle could be loaded with infant formula and sterilised water during manufacture, allowing this to be supplied ready for use and disposed of following use, as required.

In the current example, the container body 121 has a generally cylindrical shape, although this is not essential and other suitable shapes could be used. For example, the container body could have a square cross sectional shape, with the circular open ends suitable for attachment to the bottle body 111 and teat 112.

The container body 121 can be manufactured from any suitable material, such as a plastic, rubber and/or silicone. In one example, the container body 121 is made from an at least partially elastically deformable material, such as silicone, rubber, latex, a thermoplastic elastomer or the like. It will be appreciated however that any suitable material could be used which is typically biologically inert and has suitable resilience, temperature, UV and water resistive properties. The container body 121 may also be optionally coated, for example using a suitable polymer or the like, to provide or enhance desired properties.

The container body 121 can be formed using any suitable manufacturing technique, such as injection moulding, blow moulding, additive manufacturing, 3-D printing, or the like, depending on the materials used.

The body 121 may incorporate stiffening or strengthening members, such as ribs, or the like, which could be formed by inserts, such as metal or plastics spines, or from thickening of portions of the body 121. In one example, a plastic skeleton can be provided to provide structural rigidity for example at at least the first and second ends, with this being coated in silicone which then extends between the first and second ends to provide the deformable section.

The container body 121 can also include at least one ridge 124 extending around at least part of a perimeter of an inner surface of the container body 121, proximate the flared section 125. The ridge 124 can extend around the entire perimeter of an inner surface of the container body 121 although this is not essential and the ridge may include one or more separate ridges each extending around part of the perimeter.

The ridge 124 can be used to facilitate position of the sealing member 131, for example by allowing the sealing member 131 to abut against the ridge upon insertion, although this is not essential and positioning could be achieved using a tool, through alignment with a visible marking, or the like. Additionally and/or alternatively, the ridge can assist with releasing the sealing member 131, for example through physical engagement between the ridge 124 and the sealing member 131 during deformation of the container body 121, as will be described in more detail below.

The ridge 124 can also include a sloped face that abuts against a sloped face of the sealing member 131, with the abutment of the sloped faces preventing ingress of beverage formula into a seal between the sealing member and the container body.

In the example of FIGS. 1A to 1E, the one or more ridges 124 are integrally formed with the container body 121, for example by moulding the container body so as to include a thickened portion defining the or each ridge. In particular, the ridge 124 and inner surface are arranged so as to define a continuous surface into which beverage or beverage formula can come into contact with in use. The continuous surface does not include any discontinuities, corners, sharp edges, crevices or the like, with which liquid or powder can came into contact. This ensures that powder and liquid are fully mixed, whilst aiding cleaning and drying of the container body, for example allowing drying to be performed using a wipe dry process or relatively quick air drying, rather than requiring lengthy air drying, heating, or the like. Further, the lack of discontinuities, corners, sharp edges, crevices or the like allows the user to readily see whether the interior of the container is completely dry and therefore safe to use. This vastly increases the usability of the formula container compared to other traditional arrangements.

This is further facilitated by the use of shallow, and preferably gradually curved, angles and in particular no angles greater than 90°, 80°, 70°, 60°, 50°, 45°, 40° and more typically 30°. Again it will be appreciated that this facilitates effective cleaning and drying of the inside of the formula container.

The sealing member 131 can be formed from suitable materials, and this may at least to some extent depend on the mechanism used for release, as well as the need to engage with and seal against the inner surface of the container body 121. In this regard, the sealing member 131 is typically retained in position using frictional engagement between the sealing member 131 and container wall, with at least some resilience in the sealing member ensuring a suitable seal is affected.

Accordingly, in one example, the sealing member 131 can be formed from an at least partially elastically deformable material, such as silicone, rubber, latex, an elastomer or the like, allowing this to be deformed to aid release, as well as to facilitate sealing against the inner wall of the container body 121. However, other suitable materials and/or composite arrangements could be used, for example including a core material, such as a metal, shape memory alloy, aluminium or the like, with a silicone or other suitable coating applied thereto.

Additionally and/or alternatively the sealing member 131 could be made of a viscoelastic material, such as a suitable elastomer, so that the sealing member 131 has a higher viscosity that the container body 121. In this arrangement, deformation of the container body 121 in turn causes deformation, and in particular contraction of the sealing member. The container body 121 returns to the original shape faster than the sealing member 131, due to the higher viscosity of the sealing member, so that the sealing member is thereby released.

A further alternative is for the sealing member 131 to be made of a frangible or plastically deformable material, such as plastic or another similar material, allowing the sealing member 131 to be released upon breaking or bending, as will be described in more detail below.

In addition to releasing of the sealing member being dependent on the material properties of the sealing member 131 and/or container body 121, release can be facilitated by particular configurations of the ridge(s), flared section and/or sealing member.

Thus, it will be appreciated that deformation of the deformable section can cause the sealing member 131 to be released through a variety of mechanisms, including but not limited to urging of the sealing member into the flared section, expanding the diameter of the container body between the flared section and the ridge, engagement of the ridge with the surface of the sealing member, deformation of the sealing member, contraction of the sealing member and fracturing of the sealing member. Specific examples of these will now be described in further detail.

In the specific example shown in FIGS. 1A to 1E, the sealing member 131 is ellipsoidally shaped, and in one example ranging anywhere from a spherical shape to a substantially flattened oblate spheroid. The sealing member 131 is positioned in the container body 121 in abutment with the ridge(s) 124, with the sealing member 131 being urged against the inner wall of the container body 121 to thereby frictionally engage and seal against the wall surface. In this regard, the use of the ellipsoidal shape means that if the sealing member were stiff and unable to deform, there would only be a point of contact around a perimeter of the sealing member, which would provide limited sealing efficacy and frictional engagement between the sealing member and container body 121, hence the use of an at least partially deformable material is generally desired to increase the effective contact area, and hence sealing and frictional engagement.

In this example, when the container body 121 is deformed inwardly by application of a force against sides of the container body 121, as shown by the arrows F, the deformation of the deformable section causes at least part of the ridge(s) to move radially inwardly and engage and urge against a sloped face of the sealing member 131. This in turn urges the sealing member 131 towards the flared section 125 as shown by the arrow 141. As the sealing member 131 enters the flared section 125, the sealing member 131 is no longer in contact with the inner wall of the container body 121 and hence disengages from the inner surface of the container body 121.

Thus, it will be appreciated that in this instance the shape of the sealing member 131 and ridge 124 cooperate to urge the sealing member in an axial direction towards the flared section 125, thereby releasing the sealing member 131.

An alternative example will now be described with reference to FIGS. 2A to 2E. In this example similar reference numerals are used to denote similar features, albeit increased by 100, and these features will not therefore be described in any detail.

Thus, it will be appreciated that in this example, the nursing bottle 200 again includes a bottle body 211, coupled to a formula container 220, which is in turn connected to a teat 212, via a teat ring 213.

In this example, the formula container 220 includes a sealing member 231 in the form of a generally cylindrical disc having substantially flat upper and lower faces interconnected via a cylindrical wall. It will be appreciated that in this arrangement the entire cylindrical wall can contact the inner wall of the container body 221, which can increase sealing and frictional engagement compared to the arrangement of FIGS. 1A to 1E.

However, in this example, inward movement of the ridge alone may not be sufficient to displace the sealing member. Accordingly, in this example, the deformable section is positioned axially spaced from the ridge 224, towards the first end 222, so that deformation causes the ridge 224 to move radially inwardly and toward the sealing member, as shown by the arrow 242, thereby urging the sealing member 231 towards the flared section 225 so that the sealing member disengages the inner surface. Additionally, as part of this process, the flared section 225 can be stretched so as to thin or bow outwardly, as shown by the arrow 243, thereby effectively stretching the extent of the flared section 225 so that it approaches the sealing member, thereby further facilitating release of the sealing member 231.

Thus, it will be appreciated that in this example, the location of the deformable section assists in controlling the movement of the ridge 224 and optionally the flared section 225, to thereby facilitate the disengagement process. This can be used to ensure successful disengagement largely independently of the shape of the sealing member 231.

In any event, in both of the above examples, movement of the ridge 124, 224 therefore facilitates movement of the sealing member 131, 231 in an axial direction towards the flared section, as well as acting as a guide so that the sealing member 131, 231 is correctly positioned upon insertion into the container body 121, 221. In particular, the sealing member 131, 231 can simply be urged into the container body 121, 221 until it abuts the ridge 124, 224, so that the sealing member 131, 231 is positioned immediately adjacent the flared section 125, 225 so that only a small degree of movement is required before the sealing member reaches the flared section 125, 225 is no longer in frictional engagement with the inner surface of the container body. Thus it will be appreciated that frictional engagement between the sealing member and the container body affects sealing and retains the sealing member in place, whilst movement of the ridge and the location of the flared section cooperate to allow the sealing member to be released upon deformation of the container body 121, 221.

In the above example, the flared section 125, 225 serves a dual purpose, namely facilitating release of the sealing member and also expanding the diameter of the container body 121, 221 so that this can fit over a mouth of the nursing bottle body 111, 211.

Figure 3A:
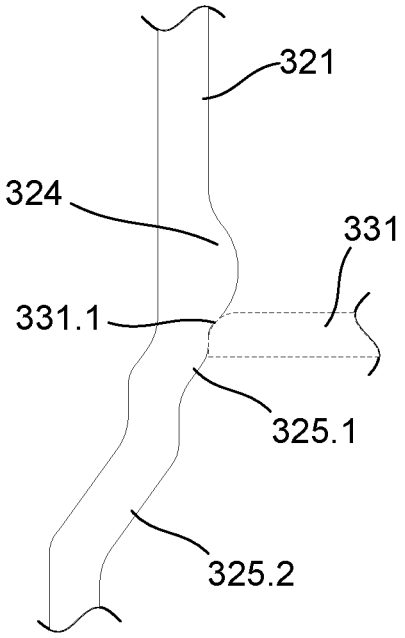
FIGS. 3A to 3E are schematic close up views showing examples of alternative arrangements of sealing members, ridges and flared section configurations.
Figure 3B:
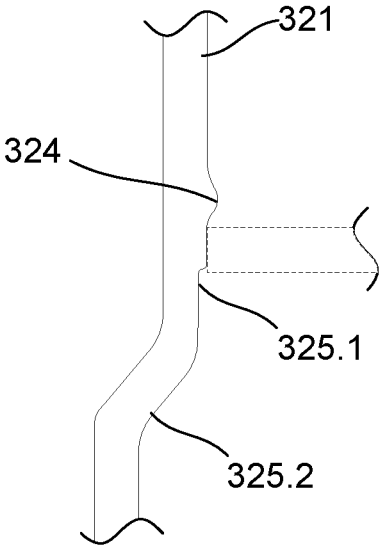
Figure 3C:
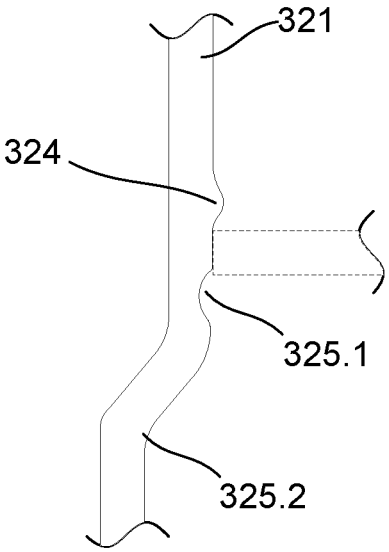

However, this is not essential and as shown in FIGS. 3A to 3C, different flaring mechanisms can be used.

In the example of FIG. 3A, the container body 321 includes first and second flared portions 325.1, 325.2 each of which leads to a successive increase in the diameter of the container body. In this instance the first flared section 325.1 is utilised to allow for the sealing member to be released whereas the second flared portion 325.2 allows the container body to fit over the bottle mouth. In the example of FIG. 3A, the sealing member 331 also includes a chamfered outer perimeter edge corner 331.1, that abuts against the ridge 324, thereby facilitating release of the sealing member in a manner similar to the ellipsoidally shaped sealing member 131 described above.

Figure 3D:
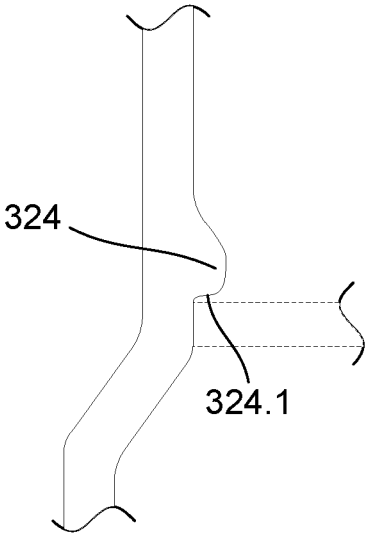

In the example of FIG. 3B, again first and second flared portions 325.1, 325.2 are shown with the first flared portion 325.1 being formed by a thinning of the container body 321, so that the outer diameter of the container body 321 remains constant in the vicinity of the flared section. In contrast in the example of FIG. 3C the first flared section 325.1 is formed by depression or groove within the container body wall. Finally, in the arrangement of FIG. 3D, the ridge is provided with a protrusion 324.1 to facilitate greater engagement between the ridge and sealing member which can facilitate ease of release of the sealing member.

Figure 3E:
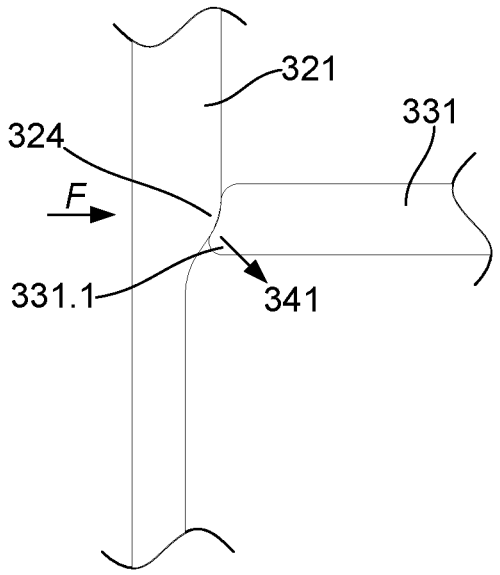

A further example is shown in FIG. 3E. In this example, the flared section 324 is formed by thinning of the container wall, so that the outer diameter of the container remains constant. Additionally, in this example, the flared section also acts to provide functionality similar to that of the ridge in the previous examples. In particular, in this example, the sealing member 331 can include at least one sealing member ridge 331.1 extending around at least part of a perimeter of the sealing member 331. In this example, the at least one sealing member ridge 331.1 can be configured to abut against at least part of the flared section 334 when the sealing member is inserted into the second end in use, with this being used to facilitate positioning of and/or release of the sealing member, in a similar manner to that described above with respect to the ridges 335. In addition to this, inward movement of the flared section 324 during deformation caused by application of force F, leads to a force shown by arrow 341 including a component in an axial direction, thereby urging the sealing member 331 into the flared section and hence out of engagement with the container body 321.

In a further example, the sealing member can include two sealing member ridges spaced apart and extending around a perimeter of the sealing member, with the sealing member ridges abutting against the inner surface to form a double seal, as will be described in more detail below.

It will be appreciated from the above that a wide variety of different configurations of sealing member, ridge and flared section can be used in order to ensure the sealing member can be suitably disengaged through inward movement of the deformable section of the container wall.

Figure 4:
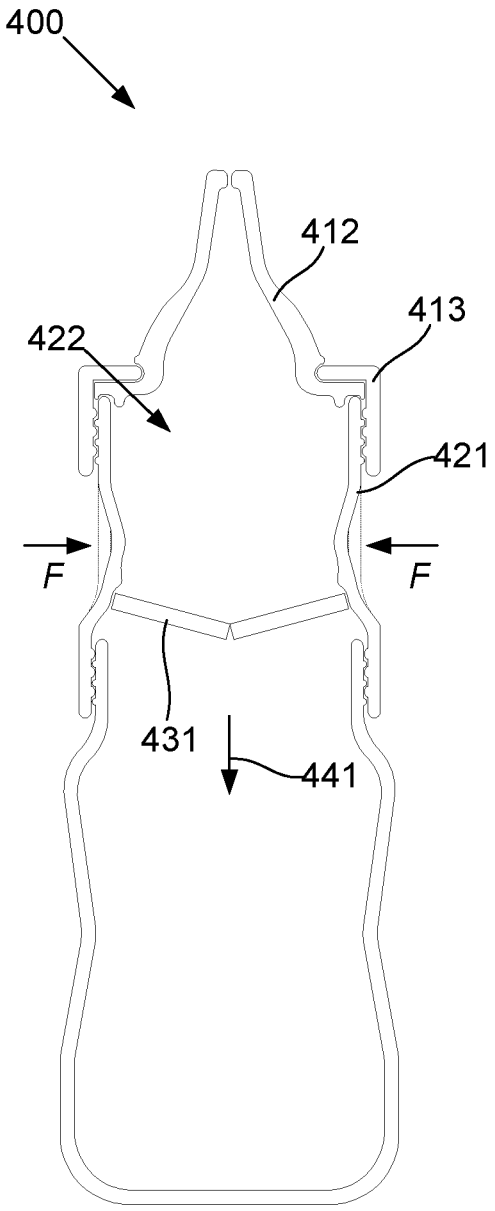
FIG. 4 is a schematic cross-sectional view of an example of a nursing bottle including a beverage formula container including an alternative sealing member.

A further example arrangement is shown in FIG. 4. Again, in this example similar reference numerals are used to denote similar features to those shown in FIGS. 1A to 1E albeit increased by 300, and these features will not therefore be described in any detail. Thus, it will be appreciated that in this example, the nursing bottle 400 includes a bottle body 411, coupled to a formula container 420, which is in turn connected to a teat 412, via a teat ring 413.

In this example, the sealing member 413 is adapted to deform or fracture to further facilitate disengagement of the sealing member 431 from the container body 421. In one particular example, the sealing 431 could be formed from a disc of shape memory alloy, such as a copper-aluminium-nickel, and nickel-titanium (NiTi) alloy, or the like. In this example, the shape memory alloy defaults to a flattened configuration on heating (or cooling). When deformed, the shape memory alloy bends, as shown in FIG. 4, allowing the sealing member to be released. When the sealing member is subsequently heated, for example during subsequent cleaning in hot water (or cooled by placement in a fridge), the disc reverts to the flattened configuration, allowing this to be reused as required.

However, this is not essential, and alternatively single-use variations could be employed in which the sealing member 431 is frangible, allowing the sealing member 431 to break into two or more parts upon the application of pressure, thereby releasing the sealing member. In this example, the sealing member would typically include a weakened portion, to ensure that the sealing member breaks into individual parts of a sufficiently large size and appropriate buoyancy to prevent these being inadvertently consumed with the resulting beverage, whilst also ensuring release of the sealing member.

An example of a nursing bottle including a re-usable anti-colic lining member will now be described with reference to FIG. 5.

In this example, similar reference numerals are used to denote similar features to those shown in FIGS. 1A to 1E albeit increased by 400, and these features will not therefore be described in any detail. Thus, it will be appreciated that in this example, the nursing bottle 500 includes a bottle body 511, coupled to a formula container 520, which is in turn connected to a teat 512, via a teat ring 513.

In this example, a re-usable lining member 551 is provided in the bottle body 511 so as to contain the beverage in use. A hole 552 is provided in the bottle body 511 to allow airflow into the region between the lining member 551 and the bottle body 511. This allows the beverage to be consumed, without the creation of negative pressure within the liquid containing part of the baby bottle. Where negative pressure builds up inside a baby bottle, this makes it difficult for the baby to remove milk from the bottle. In the absence of a system to equalise the pressure (such as vents or valves), the pressure can only be equalised by air entering the bottle through the hole in the nipple. When the baby partly or wholly removes its mouth from the teat to allow this, air can enter the baby's mouth and when it enters the hole in the nipple it aerates the milk, causing the baby to ingest air with the milk. The ingestion of air causes painful wind and gas, commonly known as 'colic'.

Figure 5:
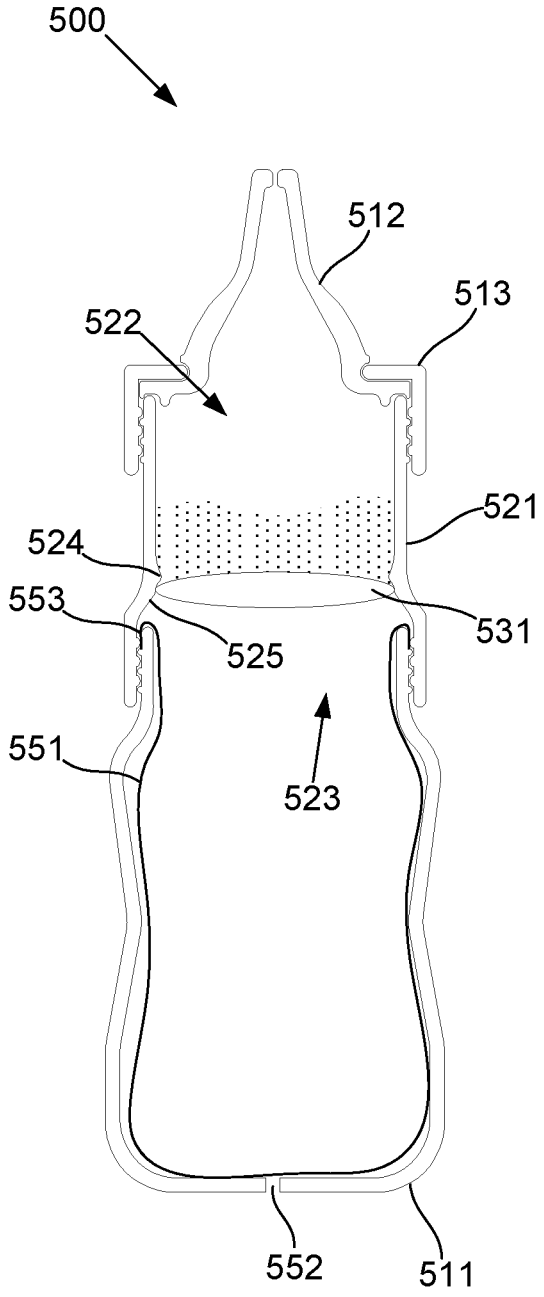
FIG. 5 is a schematic cross-sectional view of the nursing bottle and formula container of FIG. 1A when used with an anti-colic lining member.
Figure 6A:
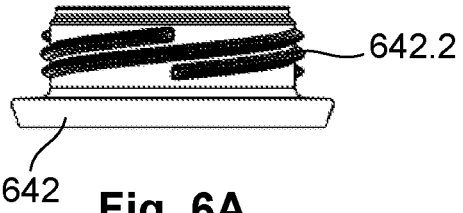
FIG. 6A is a schematic side view of an example of a first locking ring.
Figure 6E:
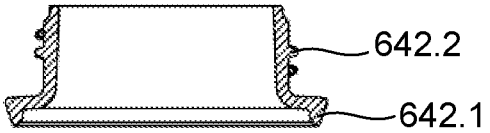
FIG. 6E is a schematic cross sectional view of the first locking ring of FIG. 6A.
Figure 6B:
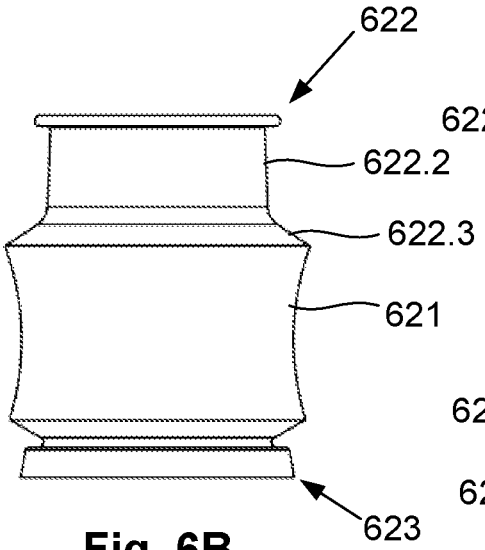
FIG. 6B is a schematic side view of an example of a container body.
Figure 6F:
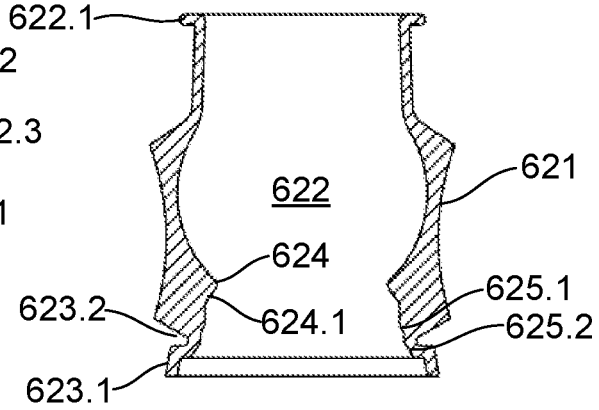
FIG. 6F is a schematic cross sectional view of an example of the container body of FIG. 6B.
Figure 6C:
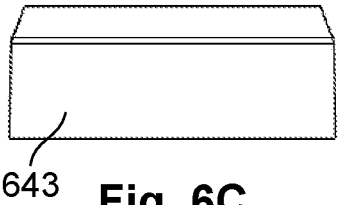
FIG. 6C is a schematic side view of an example of a second locking ring.
Figure 6G:
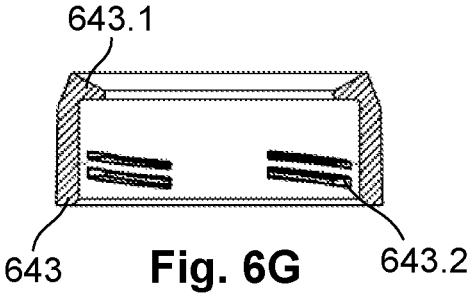
FIG. 6G is a schematic cross sectional view of an example of the second locking ring of FIG. 6C.
Figure 6D:
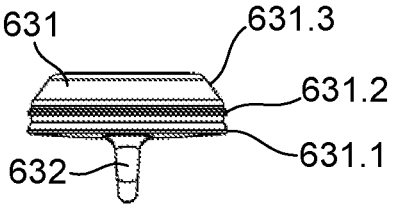
FIG. 6D is a schematic side view of an example of a sealing member.
Figure 6H:
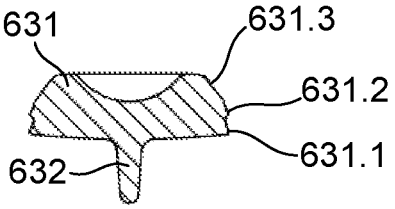
FIG. 6H is a schematic cross sectional view of an example of the sealing member of FIG. 6D.
Figure 6I:
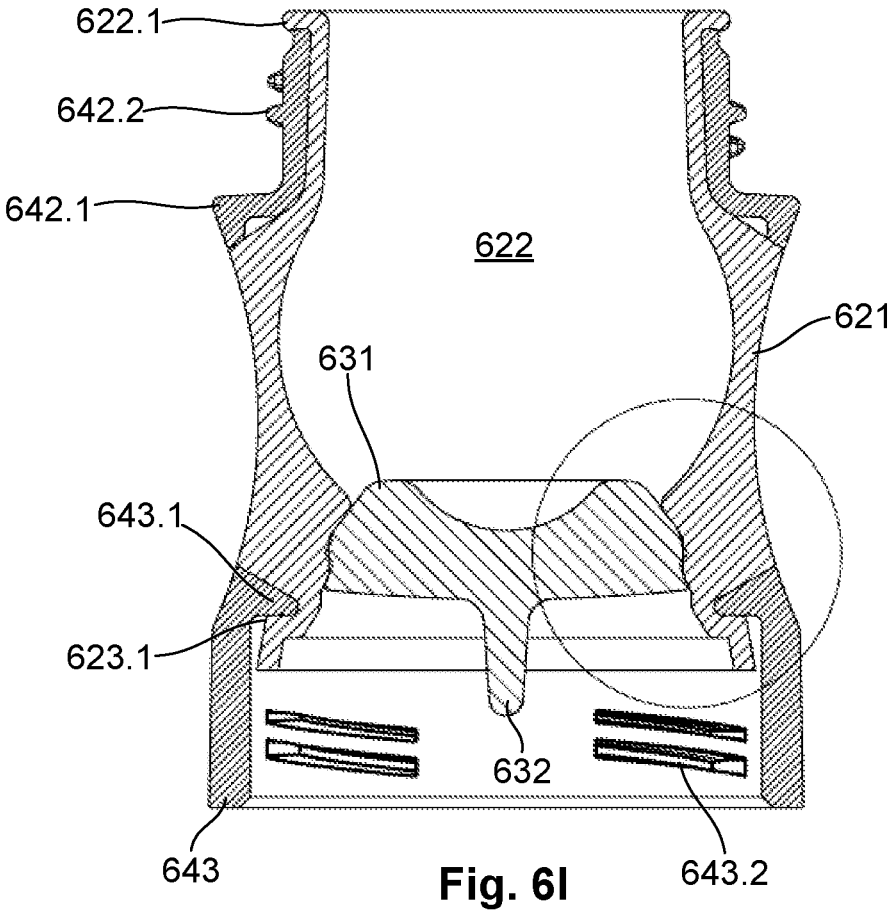
FIG. 6I is a schematic cross sectional view of a beverage formula container including the components of FIGS. 6A to 6D.
Figure 6J:
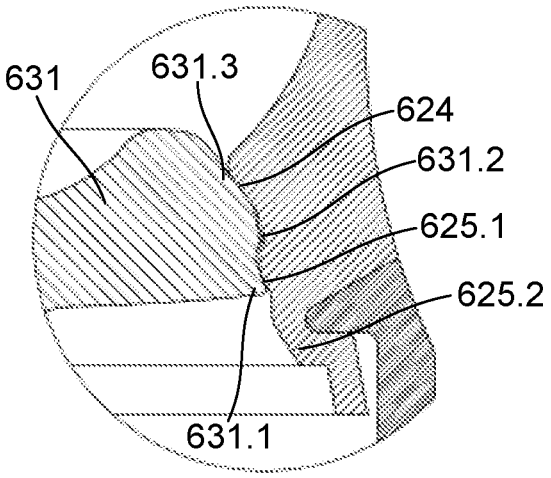
FIG. 6J is a schematic cross sectional expanded view of the sealing member and beverage formula container of FIG. 6I.
Figure 7A:
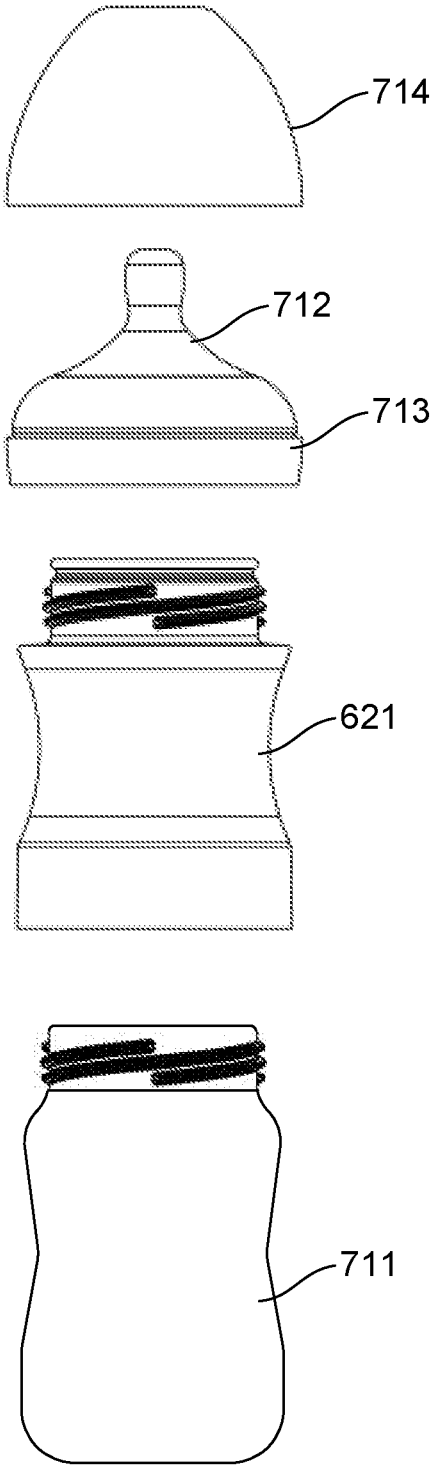
FIG. 7A is a schematic side exploded view of a nursing bottle including the beverage formula container of FIG. 6I.
Figure 7B:
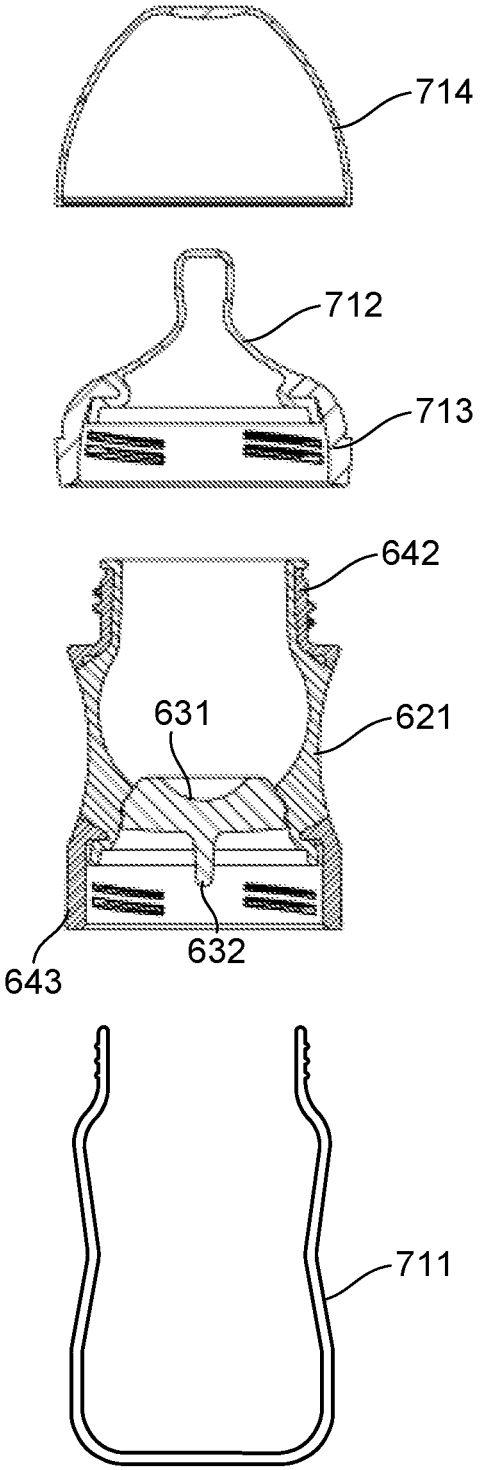
FIG. 7B is a schematic cross sectional exploded view of the nursing bottle of FIG. 7A.
Figure 7C:
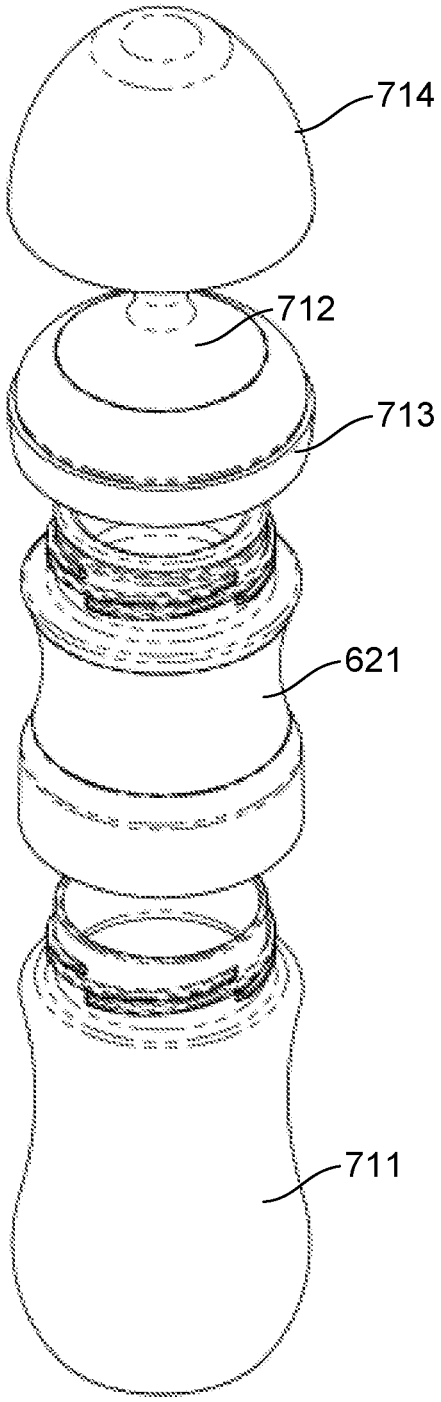
FIG. 7C is a schematic top perspective exploded view of the nursing bottle of FIG. 7A.
Figure 7D:
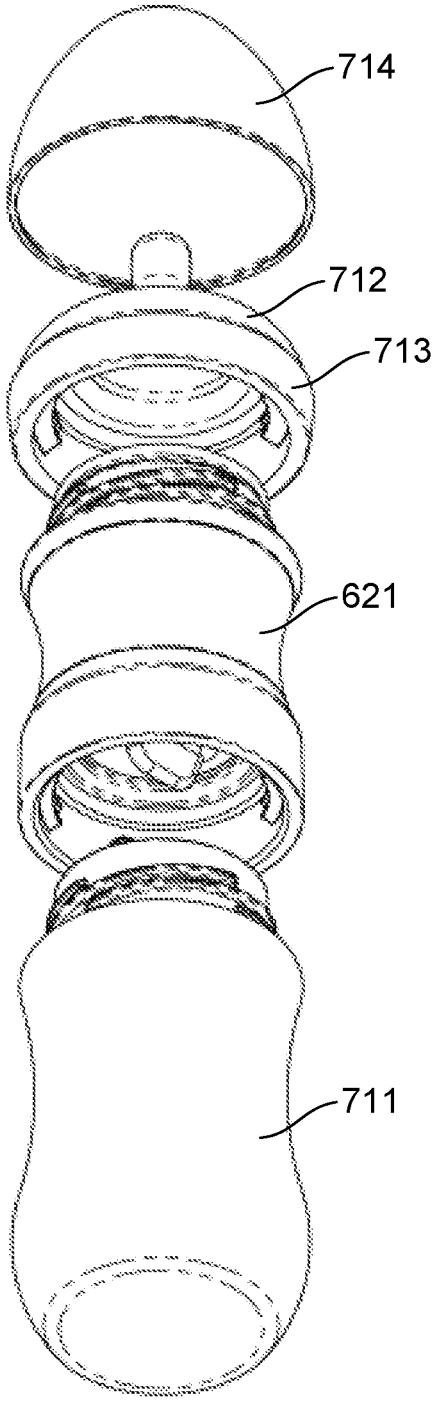
FIG. 7D is a schematic underside perspective exploded view of the nursing bottle of FIG. 7A.

In the example of FIG. 5, the lining member 551 includes a neck 553 configured for attachment over a mouth of the nursing bottle body 511, thereby allowing the lining member to be attached to and subsequently removed from the bottle body 511. It will be appreciated that other similar configurations could be used to attach the lining member. For example, the lining member could include a rim that sits within the bottle mouth and lip that extends outwardly to sit on a rim of the bottle mouth. In this instance the lip could be sandwiched between the bottle mouth rim and the formula container, to thereby secure the lining member in place within the bottle body. The lining member is typically a reusable lining member and can be made from silicone, or another flexible plastic material.

An alternative example of a beverage formula container will now be described with reference to FIGS. 6A to 6J.

In this example similar reference numerals are used to denote similar features, albeit increased by 500 compared to FIGS. 1A to 1E, and these features will not therefore be described in any detail.

In this example, the formula container body 621 includes a ridge 624 extending circumferentially around an inner surface of the container body, with the ridge 624 include a sloped underside face 624.1. First and second flared portions 625.1, 625.2 are spaced apart between the ridge 624 and a second end 623 of the container body.

The sealing member 631 includes as tapered cylindrical body having an inwardly sloping upper face 631.3, which in use abuts against the sloped underside face 624.1 of the container body ridge 624. The sealing member 631 includes two axially spaced circumferential first and second sealing ridges 631.1, 632.2. The first sealing ridge 631.1 is positioned at a lower edge of the sealing ring and is adapted to engage the first flared portion 625.1 to form a first water seal. The second sealing ridge 631.2 is axially spaced from the first sealing ridge 631.1 and is adapted to engage an inner surface of the container body between the flared portion 625.1 and the ridge 624 thereby forming a second water seal. An underside of the sealing member 631 includes a tab 632, which facilitates handling, in particular insertion and removal of the sealing member 631.

In use, abutment of the sloping faces 631.3, 624.1 provides a further sealing action, and in particular prevents ingress of beverage formula concentrate into the first and second water seals, thereby helping maintain water seal effectiveness. Additionally, the abutment of the sloping faces provides a "ramp" action that urges the sealing member 631 downwards as the container body 621 is squeezed, which is further facilitated by the container body having a waist in a central region, so that squeezing of the waist urges the ridge 624 inward and downward.

In this example, the container body does not include threaded portions, but instead the first and second ends 622, 623 engage respective threaded locking rings configured to threadingly engage a teat ring and a nursing bottle body respectively.

In this regard, the first end 622 of the container body includes a lip 622.1 extending outwardly from a mouth of the container body, and a shoulder 622.3 spaced apart from the lip 622.1, to define a neck 622.2, which in use receives a first locking ring 642. The first locking ring 642 has a generally cylindrical body terminating in outwardly extending flange 642.1. In use, the locking ring 642 is urged over the lip 622.1, allowing the locking ring to be located in the neck 622.2, with the body engaging the lip 622.1, and the flange 642.1 engaging the shoulder 622.3, to thereby retain the locking ring 642 in position. The locking ring includes external threads 642.2 that engage a teat ring in use.

The second end 623 of the container body includes outwardly extending flared rim 623.1 defining a recess 623.2 behind the rim 623.1. The second locking ring 643 has a generally cylindrical body having an inwardly extending lip 643.1 at one end, which in use engages the recess 623.1, thereby coupling the second locking ring 643 to the container body 621. The second locking ring includes internal threads 643.2 that engage a beverage receptacle in use.

Use of the beverage formula container of FIGS. 6A to 6J as part of a nursing bottle is shown in FIGS. 7A to 7D, which further includes a bottle body 711 that engages with the with the second locking ring 643, and a teat 712 having a teat ring 713 that engages with the first locking ring 642. A cap 714 to cover the teat may also be provided.

Figure 8C:
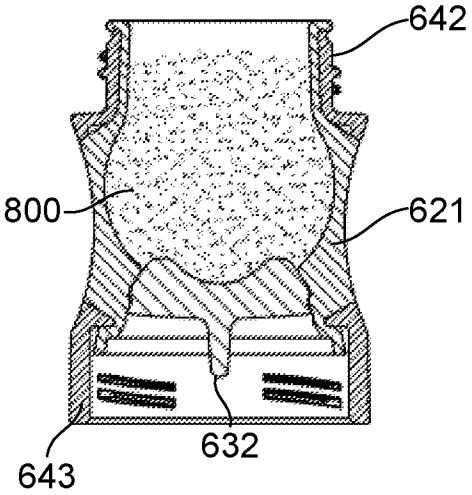
FIGS. 8A to 8C are schematic cross sectional views showing loading of the beverage formula container of FIG. 6I; and, FIGS. 8D to 8F are schematic cross sectional views showing mixing of beverage formula in the nursing bottle of FIG. 7A.
Figure 8B:
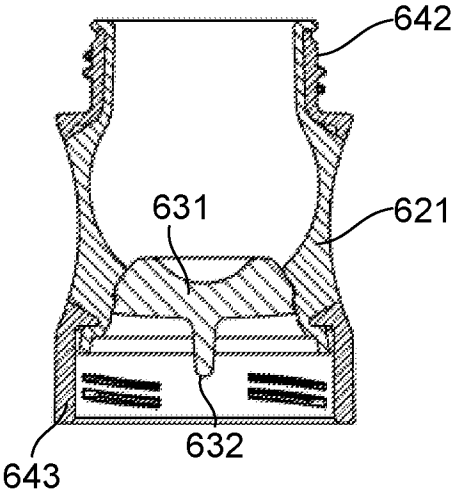
Figure 8A:
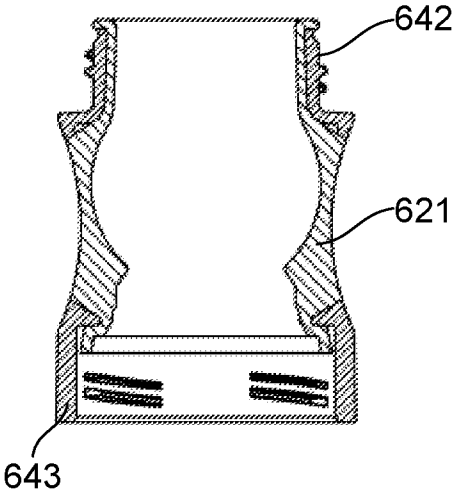
Figure 8F:
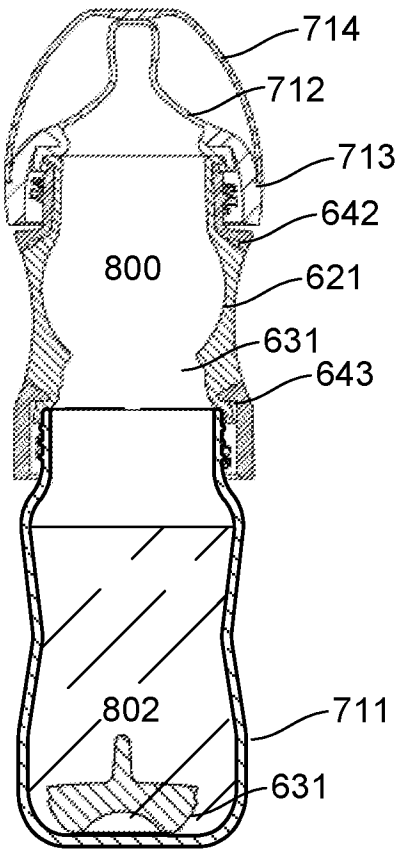
Figure 8E:
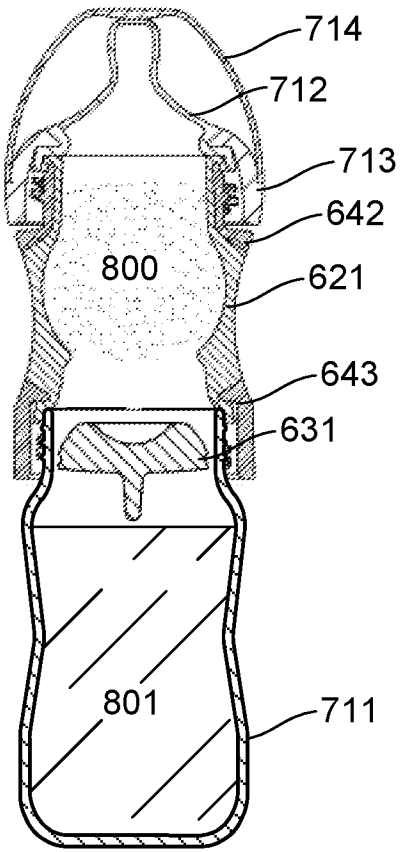
Figure 8D:
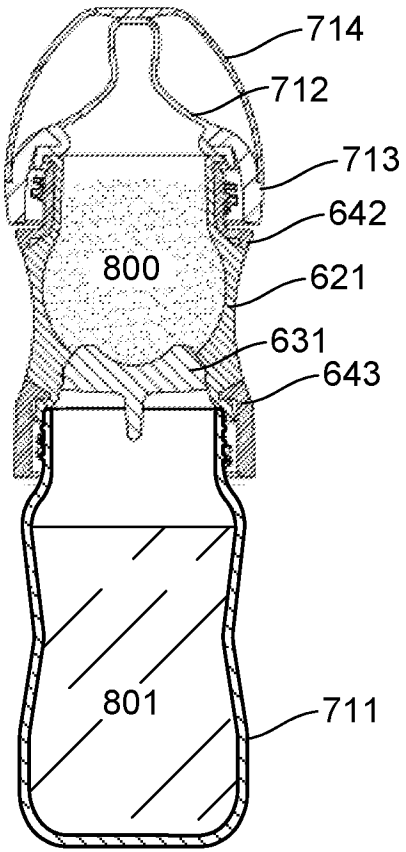

Filling of the beverage formula container is shown in FIGS. 8A to 8C, with the sealing member 631 initially being inserted into the container body 621, until the sealing member 631 engages the ridge 624, with the container then being filled with formula 800. Creation of a beverage is then achieved as shown in FIGS. 8C to 8D, by attaching the container to a bottle body 711 filled with water 801. The container body 621 is then squeezed, thereby releasing the sealing member 631 and allowing the beverage formula 800 to mix with the water 801 to form the beverage 802. In this regard, the sealing member 631 is typically made of silicone, to thereby minimise noise caused by impact between the sealing member and the bottle 711 as the arrangement is shaken to facilitate mixing of the formula and water.

Accordingly, the above described arrangement provides a nursing bottle including a formula container, as well as a formula container for attachment to an existing nursing bottle. The formula container includes a sealing member that sealingly engages an inner wall of the container, thereby forming a chamber into which beverage formula can be provided. The sealing member can be released through deformation of the container, specifically through interaction of the sealing member with a flared section of the container and/or a ridge within the container, that operate to release the sealing member upon deformation of the container body.

In one example, the above described arrangement can be used to pre-load a nursing bottle with powdered infant formula, so that when an infant formula beverage is to be prepared, the formula container can be squeezed releasing the powder into water in the nursing bottle body, with suitable agitation allowing the beverage to be produced. This can be used in a wide variety of circumstances, such as to provide a pre-prepared bottle for night-time feeding, or to allow a pre-prepared bottle to be carried, for example in a carry bag, for feeding while away from preparation facilities.

In such scenarios, it will be appreciated that it is important the water in the nursing bottle body is retained at the required temperature for the baby's comfort. Accordingly, in one example, the nursing bottle body could be provided in a heat insulated carrying container, thereby retaining heat within the container so the water remains warm until use. In one example, this can be in the form of a sleeve that fits over the bottle body, so that this does not interfere with release of the formula. However, it will also be appreciated that alternatively the container could be a rigid container extending over the formula container to help prevent inadvertent deformation of the container body, for example if the nursing bottle is being carried in a bag for use on the move.

It will of course be appreciated that alternatively water could be carried separately, for example in a flask or other similar vessel. Additionally and/or alternatively the nursing bottle could include thermochromic markings or the like, that provide a visual indication of whether the water is at the correct temperature.

Whilst the above examples have focused on the use of the formula container for use with a nursing bottle, it will be appreciated that the general concept can be applied more broadly, and in particular could be used with any beverage receptacles, for producing a range of different beverages. For example, this could be used with sippy cups to provide nutritional or non-nutritional beverages to children, or could be used with travel mugs, or similar receptacles, for example to allow for hot drinks such as tea, coffee or soup to be prepared whilst away from suitable facilities. In this situation, the beverage could be stored in powdered form within the beverage formula container, and released when required. This is particularly useful in scenarios where preparing a beverage might otherwise be difficult, for example when driving, but it is preferred to mix the beverage shortly before consumption to maintain beverage properties.

In addition to use with beverages, the system could have broader application for the mixing of any substances. For example, this could be used in a medical environment to mix formulations prior to administration.

For example, some medications, such as Human Chorionic Gonadotropin can be supplied as a single powdered dose that needs to be combined with a water based solvent before injection. In this situation, the powered medication could be contained in a formula container, which is sealed at a first end with a piercable lid, such as a foil lid, membrane or the like. In use, this is attached to a receptacle such as a vial containing the water based solvent, allowing the medication to be released into and mixed with the water as required. Once suitably mixed, a syringe can be inserted through the piercable lid, allowing the liquid medication to be extracted directly into the syringe and injected as required.

It will be appreciated that this provides a simple straightforward mechanism for mixing medication and in particular avoids complex containers with moving parts, whilst providing a mechanism to easily allow for storage and mixing of medication, making this suitable for home use.

Accordingly, in a further example, a formula container can be provided for use in preparing a liquid formulation. In this example, the formula container can include a container body extending from a first end configured for dispensing a liquid formulation to a second open end configured for attachment to a receptacle body, such as a vial or similar. The container body can again include a flared section and an at least partially deformable section in proximity of the flared section. A sealing member can be provided, inserted into the second end so as to sealingly engage an inner surface of the container body proximate the flared section so as to form a chamber between the sealing member and first end, the chamber being configured to receive formula, such as a dose of medication therein. When the deformable section is deformed, this allows the sealing member to disengage the inner surface of the container body and pass through the flared section and the second end, thereby releasing formula through the second end into an attached receptacle body, whereby the formula is mixed with a liquid contained in the receptacle body to form the liquid formulation.

The above described system can therefore be used in any situation in which liquid formulations are to be created either by mixing a powdered formula with a liquid or by mixing two liquids.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

Persons skilled in the art will appreciate that numerous variations and modifications will become apparent. All such variations and modifications which become apparent to persons skilled in the art, should be considered to fall within the spirit and scope that the invention broadly appearing before described.

The invention claimed is:

1. A beverage formula container for use with a beverage nursing bottle, the beverage formula container including:

a) a substantially cylindrical and hollow container body extending from a first, top, open end configured for attachment to a teat for dispensing a beverage to a second, bottom, open end configured for attachment to a top end of a nursing bottle body of the nursing bottle, the container body including:

i) external threads on the first end, the external threads being configured to threadingly engage a teat ring allowing the teat to be coupled thereto;

ii) internal threads on the second end, the external threads being configured to threadingly engage the nursing bottle body allowing the container body to be coupled thereto;

iii) a flared section;

and, iv) an at least partially deformable section in proximity of the flared section, wherein the container body is configured so that the deformable section is deformable radially inwardly by application of a squeezing force against at least one side of the container body;

b) a sealing member configured to be inserted into the second end so as to sealingly engage an inner surface of the container body proximate the flared section so as to form a chamber between the sealing member and the first end, the chamber being configured to receive beverage formula therein, and wherein deformation of the deformable section allows the sealing member to disengage the inner surface of the container body and pass through the flared section and the second end, thereby releasing beverage formula through the second end into an attached nursing bottle body.

2. A beverage formula container according to claim 1, wherein the formula container includes at least one ridge extending around at least part of a perimeter of the inner surface of the container body proximate the flared section and wherein the sealing member is configured to abut against the at least one ridge when the sealing member is inserted into the second end in use.

3. A beverage formula container according to claim 2, wherein the at least one ridge includes a sloped face that abuts against a sloped face of the sealing member and wherein abutment of the sloped faces prevents ingress of beverage formula into a seal between the sealing member and the container body.

4. A beverage formula container according to claim 1, wherein the sealing member includes at least one sealing member ridge extending around at least part of a perimeter of the sealing member and wherein the at least one sealing member ridge is configured to abut against at least part of the flared section when the sealing member is inserted into the second end in use.

5. A beverage formula container according to claim 1, wherein the sealing member includes at least two sealing member ridges spaced apart and extending around a perimeter of the sealing member, wherein the sealing member ridges abut against the inner surface to form a double seal.

6. A beverage formula container according to claim 1, wherein the inner surface defines a continuous surface into which beverage or beverage formula can come into contact in use and wherein the continuous surface at least one of:

a) does not include any discontinuities; and, b) does not include any angles greater than at least one of 90°; 80°; 70°; 60°; 50°; 45°; 40°; and 30°.

7. A beverage formula container according to claim 1, wherein deformation of the at least partially deformable section causes at least one of:

a) urging of the sealing member into the flared section;

b) expansion of a container body diameter proximate the flared section;

c) engagement of at least one ridge with a surface of the sealing member;

d) deformation of the sealing member;

e) contraction of the sealing member; and, f) fracturing of the sealing member.

8. A beverage formula container according to claim 1, wherein deformation of the at least partially deformable section causes at least part of at least one ridge to move radially inwardly and towards the flared section to engage a face of the sealing member, thereby urging the sealing member towards the flared section so that the sealing member disengages the inner surface.

9. A beverage formula container according to claim 1, wherein at least one of:

a) the sealing member is made of at least one of:

i) plastic;

ii) silicone;

iii) rubber;

iv) latex;

v) an elastomer;

vi) a metal;

vii) a shape memory alloy; and, viii) aluminium, b) the container body is made of at least one of:

i) plastic;

ii) silicone;

iii) rubber;

iv) latex;

v) an elastomer; and, vi) aluminium.

10. A beverage formula container according to claim 1, wherein:

a) the first end of the container body includes:

i) a lip extending outwardly from a mouth of the container body;

ii) a shoulder spaced apart from the lip to define a neck configured to receive a first locking ring, wherein the first locking ring includes the external threads:

b) the second end of the container body includes an outwardly extending flared rim defining a recess behind the rim configured to receive a second locking ring including the internal threads.

11. A beverage formula container according to claim 1, wherein the first and second ends engage respective first and second threaded locking rings including the external and internal threads, respectively.

12. A beverage formula container according to claim 1, wherein the beverage formula includes at least one of:

a) powdered infant formula;

b) liquid infant formula;

c) a nutritional composition;

d) a medicated formulation;

and, e) an isotonic drink formulation.

13. A beverage receptacle including:

a) a beverage receptacle body;

b) a lid;

c) a beverage formula container including:

i) a container body extending from a first, top, open end configured for attachment to the lid to a second, bottom, open end configured for attachment to a top end of the beverage receptacle body, the container body including:

(1) external threads on the first end, the external threads being configured to threadingly engage the lid allowing the lid to be coupled thereto;

(2) internal threads on the second end, the external threads being configured to threadingly engage the beverage receptacle body allowing the beverage receptacle body to be coupled thereto;

(3) a flared section;

(4) an at least partially deformable section in proximity of the flared section, wherein the container body is configured so that the deformable section is deformable radially inwardly by application of a squeezing force against at least one side of the container body; and, ii) a sealing member configured to be inserted into the second end so as to sealingly engage an inner surface of the container body proximate the flared section so as to form a chamber between the sealing member and the first end, the chamber being configured to receive beverage formula therein, and wherein deformation of the deformable section allows the sealing member to disengage the inner surface of the container body and pass through the flared section and the second end, thereby releasing beverage formula through the second end into an attached beverage receptacle body.

14. A nursing bottle including:

a) a nursing bottle body;

b) a teat;

c) a teat ring;

d) a beverage formula container including:

i) a container body extending from a first, top, open end configured for attachment to the teat to a second, bottom, open end configured for attachment to a top end of the nursing bottle body, the container body including:

(1) external threads on the first end, the external threads being configured to threadingly engage the teat ring allowing the teat to be coupled thereto:

(2) internal threads on the second end, the external threads being configured to threadingly engage the nursing bottle body allowing the container body to be coupled thereto:

(3) a flared section proximate the second end;

(4) at least one ridge extending around at least part of a perimeter of an inner surface of the container body proximate the flared section; and, (5) an at least partially deformable section in proximity of the ridge wherein the container body is configured so that the deformable section is deformable radially inwardly by application of a squeezing force against at least one side of the container body; and, ii) a sealing member configured to be inserted into the second end so as to sealingly engage an inner surface of the container body proximate the flared section so as to form a chamber between the sealing member and the first open end, and wherein deformation of the deformable section allows the sealing member to disengage the inner surface of the container body and pass through the flared section and the second end, thereby releasing beverage concentrate through the second end into the nursing bottle body.

15. A nursing bottle according to claim 14, wherein the nursing bottle is configured for use with a re-usable lining member containing the beverage and wherein the nursing bottle includes a hole allowing air flow into a region between the nursing bottle body and the lining member.

16. A nursing bottle according to claim 15, wherein the lining member at least one of:

a) includes a neck configured for attachment to a mouth of the nursing bottle body, b) is a reusable lining member, b) is made of at least one of plastic and silicone.

17. A method of preparing a beverage in a nursing bottle, the method including:

a) positioning a sealing member in a substantially cylindrical and ho-low container body, the container body extending from a first, top, open end configured for attachment to a teat for dispensing a beverage to a second, bottom, open end configured for attachment to a top end of nursing bottle body, the container body including:

i) external threads on the first end, the external threads being configured to threadingly engage a teat ring allowing the teat to be coupled thereto;

ii) internal threads on the second end, the external threads being configured to be threadingly engage the nursing bottle body allowing the container body to be coupled thereto;

iii) a flared section;

iv) an at least partially deformable section in proximity of the flared section, wherein the container body is configured so that the deformable section is deformable radially inwardly by application of a squeezing force against at least one side of the container body, the method including positioning the sealing member by inserting the sealing member into the second end so as to sealingly engage the inner surface of the container body proximate the flared section so as to form a chamber;

b) providing the beverage formula into the chamber;

c) attaching the second end to a nursing bottle body containing water; and, d) deforming the deformable section to allow the sealing member to disengage the inner surface of the container body and pass through the flared section and the second end, thereby releasing beverage concentrate through the second end into the attached nursing bottle body.

18. A method according to claim 17, wherein the method includes at least one of:

a) attaching the first, top, end to a receptacle lid after providing the beverage formula therein, b) mixing the beverage formula and water by at least one of agitating and shaking the nursing bottle.

* * * * *